US005685381A

United States Patent [19]

Kloppers et al.

[11] Patent Number: 5,685,381

[45] Date of Patent: Nov. 11, 1997

[54] DRILL ROD AND DRILL BIT WITH ROCKING CONNECTION

[75] Inventors: Stephanus Frederick Kloppers; Jean Frederick Kloppers, both of Postmasburg, South Africa

[73] Assignee: Kennametal South Africa (Proprietary) Limited, Boksburg, South Africa

[21] Appl. No.: 551,528

[22] Filed: Nov. 1, 1995

[30] Foreign Application Priority Data

Jul. 21, 1995 [ZA] South Africa ..... 95/6123

[51] Int. Cl.[6] ..... E21B 10/14

[52] U.S. Cl. ..... 175/343; 175/414

[58] Field of Search ..... 175/214, 414, 175/85, 325.2, 343, 350; 408/188, 189, 226; 166/377; 299/102, 113

[56] References Cited

U.S. PATENT DOCUMENTS

| | | | |
|---|---|---|---|
| 769,080 | 8/1904 | Heefer | 175/414 |
| 1,899,458 | 2/1933 | Erickson | 175/414 |
| 3,027,953 | 4/1962 | Coski | 175/414 |
| 3,213,951 | 10/1965 | Eeles | 175/414 |
| 3,304,816 | 2/1967 | Galorneau . | |
| 3,336,081 | 8/1967 | Ericsson | 175/414 |
| 3,519,309 | 7/1970 | Engle et al. . | |
| 3,605,924 | 9/1971 | Donegan . | |
| 3,655,244 | 4/1972 | Swisher . | |
| 4,226,290 | 10/1980 | McSweeney . | |
| 4,337,980 | 7/1982 | Krekeler | 299/91 |
| 4,427,082 | 1/1984 | Sarin et al. . | |
| 4,474,488 | 10/1984 | Pinkerton et al. | 175/414 |
| 4,540,200 | 9/1985 | Larsson | 285/332.4 |
| 4,632,195 | 12/1986 | Emmerich . | |
| 4,702,328 | 10/1987 | McSweeney et al. . | |
| 4,773,490 | 9/1988 | McSweeney et al. . | |
| 4,862,976 | 9/1989 | Meek . | |
| 5,020,780 | 6/1991 | Woodings | 408/226 X |
| 5,088,797 | 2/1992 | O'Neill . | |
| 5,302,005 | 4/1994 | O'Neill . | |
| 5,494,382 | 2/1996 | Kloppers . | |

*Primary Examiner*—Frank Tsay
*Attorney, Agent, or Firm*—John J. Prizzi

[57] ABSTRACT

A drill bit is fictionally received over a drill rod via complementary generally frusto-conical male formation and socket. The socket has an inwardly protruding face at an angle with the longitudinal axis of the drill rod. The male formation on the drill rod has a depression in the form of an area where the convexity of the frusto-conical portion has been flattened at an angle so as to form a rocking formation at a selective location relative to the opposite ends of the male formation and the socket. A clearance space diverges away from the rocking formation toward a selective ends of the male formation and the socket. The frusto-conical male formation and the socket are a-circular and form positive driving engagement between the drill rod and the drill bit. An impact at the point of maximum clearance causes rocking about the rocking formation to break static friction and to facilitate release of the drill bit from the drill rod.

12 Claims, 1 Drawing Sheet

DRILL ROD AND DRILL BIT WITH ROCKING CONNECTION

BACKGROUND OF THE INVENTION

The invention relates to a combination of a drill bit and a drill rod, as well as a method of detaching, or releasing, a drill bit from a drill rod.

The kind of drill rod and drill bit combination to which this invention relates typically comprises a drill rod having at one end thereof a frusto-conical male formation. At one end of the drill bit is an abrasion-resistant insert for drilling formations and at an opposed end of the drill bit is a frusto-conical socket that is complementary in shape to the frusto-conical end of the drill rod.

Conventionally, the drill bit is received on the rod whereby the male formation of the drill rod and female socket of the drill bit are in a mating relationship. In operation, the forces transmitted from the drill rod to the drill bit are axial and rotary, or rotary alone. There is a frictional locking between these components to effect a driving connection of the drill bit to the drill rod.

SUMMARY OF THE INVENTION

In accordance with a first aspect of this invention, there is provided a combination of a drill rod and a drill bit in which the drill rod includes a generally frusto-conical end portion and an area of limited angular extent on the frusto-conical end portion which is flattened to provide a depressed face which is flat and of a predetermined width. The drill bit has, at one end thereof, a generally frusto-conical socket complementary to the frusto-conical end portion of the drill rod. The drill bit further has, along an area of limited angular extent, a generally radially inwardly protruding face complementary to the depressed face of the drill rod. The drill bit is received over the drill rod such that the generally frusto-conical socket surrounds the generally frusto-conical end portion of the drill bit and the protruding face seats on the depressed face.

In accordance with a second aspect of this invention, there is provided a combination of a drill rod and a drill bit in which the drill rod has a generally frusto-conical male formation at one end thereof and a depressed face at an angular portion along the generally frusto-conical male formation. The drill bit has, at one end thereof, a generally frusto-conical socket formation complementary to the generally frusto-conical male formation in the one end of the male formation. The drill bit further includes a generally radially inwardly protruding face at an angular portion along a wall of the generally frusto-conical socket formation. The drill bit socket formation is received over the drill rod male formation with the depressed face and the protruding face in register. The combination of the drill bit and the drill rod includes rocking formations respectively on the depressed face and the protruding face which abut to form a clearance space between the inwardly protruding face and the depressed face. The clearance space extends from the rocking formations to an extremity of one of the frusto-conical male formation and the frusto-conical socket to provide lost motion in pivot about the rocking formation.

In accordance with a third aspect of this invention, there is provided a method of releasing a drill bit received over an end of a drill rod in which the drill rod and the drill bit have on the respective frusto-conical formations inter-abutting rocking formations at an asymmetric angular position and form a clearance space longitudinally adjacent the rocking formations providing lost motion in pivoting about the rocking formations between the drill rod and the socket of the drill bit. The method includes delivering an impact to the drill bit at a predetermined position to cause rocking about the rocking formations to break static frictional engagement between the male formation of the drill rod and the socket formation of the drill bit.

BRIEF DESCRIPTION OF THE DRAWINGS

The invention is now described by way of example with reference to the accompanying drawings. In the drawings.

DETAILED DESCRIPTION OF PREFERRED EMBODIMENTS

Figure 1:
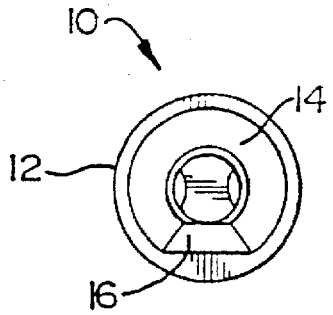
FIG. 1 is an end view from the open end of one specific embodiment of a drill bit of this invention.

With reference to FIG. 1 of the drawings, a drill bit in accordance with this invention, generally designated as 10, includes an elongate body 12 having, at one end which is not shown, drilling formations, i.e., a hard insert used to drill earth strata formations. At an opposed end, it has a socket 14 which is defined by a frusto-conical wall. In accordance with the invention, at a predetermined angular position, there is provided an inwardly protruding protrusion 16. The protrusion 16 conveniently has a flat surface. The drill bit 10 is generally of molded construction and the protrusion 16 is integrally molded as a part of the wall that defines the socket 14.

Figure 2:
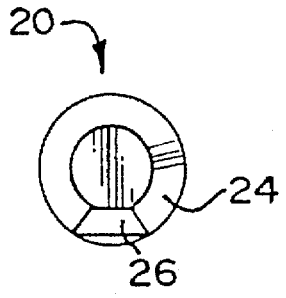
FIG. 2 is an end view of a specific embodiment of a drill rod of this invention.

With reference to FIG. 2, a drill rod in accordance with the invention is generally indicated by reference numeral 20. The drill rod 20 has a frusto-conical male formation 24 at one end. In accordance with the invention, in the frusto-conical male formation 24, there is provided a flat depressed surface or face 26 providing a relatively depressed area or notch, i.e., an area which lies within a geometrical demarcation corresponding to a hypothetical symmetric outline of the male formation.

Figure 3:
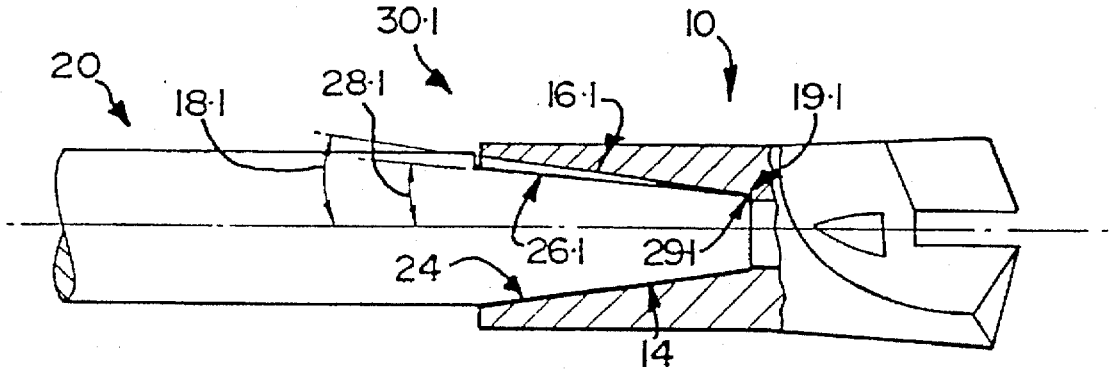
FIG. 3 is a side view of one specific embodiment of the combination of the drill bit (in partial cross-section) and drill rod wherein the rocking formation is at the smaller ends of the frusto-conical portions thereof.

With reference to FIG. 3 there is shown a combination, generally designated as 30.1, of the drill bit 10 and the drill rod 20 respectively of FIGS. 1 and 2. It is shown that the drill bit 10, and more specifically, its socket 14, is received on or seated on the frusto-conical formation 24 of the drill rod 20. The relative orientation is such that the protrusion 16.1 seats on the depression 26.1 so that the protrusion 16.1 engages the depression 26.1. Thus, a positive driving connection between the drill rod 20 and the drill bit 10 is provided which prevents the drill bit from slipping relative to the drill rod in operation. The applicants are of the opinion that such positive driving connection is particularly advantageous in the case of those drill bit and drill rod combinations which are operated predominantly by rotation as opposed to percussion combined with rotation. It is thus expected that this invention will find particular application in coal mining where drilling is generally or predominantly done by way of rotation.

Still referring to FIG. 3, in accordance with the second aspect of this invention, the protrusion 16.1 abuts the depression 26.1 as shown respectively at 19.1 and 29.1 to provide rocking formations in accordance with the invention. In this embodiment, it is seen that the rocking formation is at the smaller diameter end of the frusto-conical male formation 24.

It is shown that the angle 28.1 which the depression 26.1 forms is slightly shallower or narrower than the angle 18.1 which the protruding face 16.1 forms with an axis of the socket. Thus, toward one side of the rocking formation 19.1, 29.1, a clearance space is provided which allows lost motion, and thus, rocking about the rocking formation 19.1 and 29.1. This clearance space extends from the rocking formation to the larger diameter end of the frusto-conical male formation 24.

In use, when the drill bit 10 is seated on the drill rod 20, at the rocking formation 19.1 and 29.1, the protruding face 16.1 seats on the depressed face 26.1 to provide positive driving connection between the drill rod and the drill bit.

When the drill bit 10 is to be detached or removed from the drill rod 20, in accordance with the invention, an impact is delivered to the drill bit 10, e.g. by means of a hammer, at a position in register with the area or maximum clearance i.e. on the body of the drill bit 10 remote from the rocking formation 19.1 and at the angular position of the protrusion 16.1. Such impact breaks static friction between the walls of the components to release the drill bit 10 and to allow it to be removed from the drill rod 20.

Figure 4:
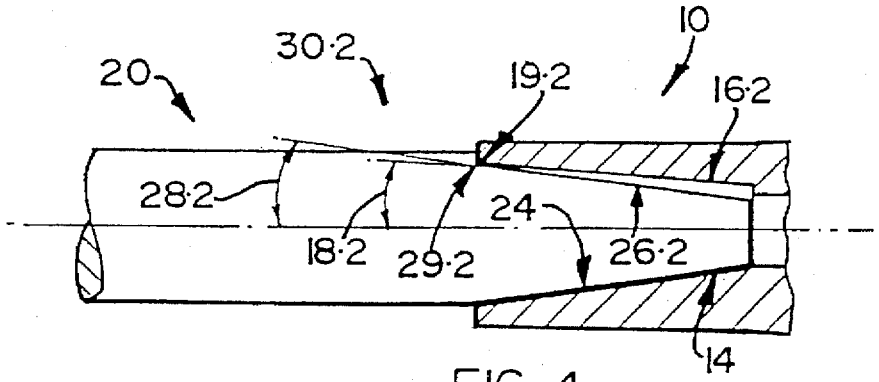
FIG. 4 is a side view of another specific embodiment of the combination of the drill bit (in partial cross-section) and drill rod wherein the rocking formation is at the larger ends of the frusto-conical portions thereof.

With reference to FIG. 4, another combination, generally designated as 30.2, is shown. Many features are similar or even identical and the same or like reference numerals are used to refer to the same or like features or components. The principal difference between the combination of FIGS. 3 and 4 is that, in the case of the embodiment of FIG. 4, the rocking formation 19.2 and 29.2 is provided at the larger cross-sectional ends of the frusto-conical formations and the area of maximum clearance is provided at the ends of smaller cross-sectional dimension.

It is shown that the angle 28.2 which the depression 26.2 forms is slightly larger than the angle 18.2 which the protruding face 16.2 forms with an axis of the socket. Thus, toward one side of the rocking formation 19.2, 29.2, a clearance space is provided which allows lost motion, and thus, rocking about the rocking formation 19.2 and 29.2. This clearance space extends from the rocking formation to the smaller diameter end of the frusto-conical male formation 24.

When the drill bit 10 is to be detached or removed from the drill rod 20, in accordance with the invention, an impact is delivered to the drill bit 10, e.g. by means of a hammer, at a position in register with the area or maximum clearance i.e. on the body of the drill bit 10 remote from the rocking formation 19.2 and at the angular position of the protrusion 16.2. Such impact breaks static friction between the walls of the components to release the drill bit 10 and to allow it to be removed from the drill rod 20.

Figure 5:
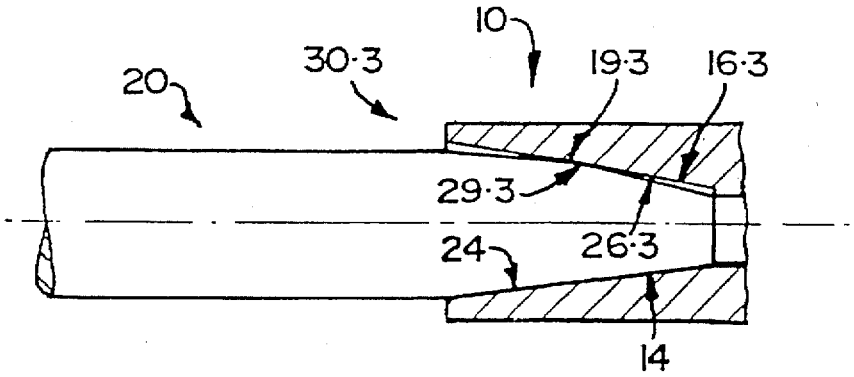
FIG. 5 is a side view of still another specific embodiment of the combination of the drill bit (in partial cross-section) and drill rod wherein the rocking formation is intermediate the opposite ends of the frusto-conical portions thereof.

With reference to FIG. 5, a third combination, generally designated as 30.3, is shown, and the same or like reference numerals are again utilized to refer to the same or like components or features compared to FIGS. 3 and 4. The principal difference between the embodiment of FIG. 5 and the embodiments of FIGS. 3 and 4 is that the rocking formations 19.3, 29.3 are generally midway along the lengths of the frusto-conical portions, i.e., intermediate the smaller and larger cross-sectional ends of the frusto-conical male formation 24 and the frusto-conical socket, and clearance is provided to either side of the rocking formations 19.3, 29.3.

In order to form the rocking formations 19.3, 29.3 intermediate of the larger and smaller diameter ends of the frusto-conical male formation 24, the depression has two distinct portions. One portion is axially rearward of the rocking formations so as to be nearest to the larger diameter end of the frusto-conical male formation 24. The other portion is axially forward of the rocking formations so as to be nearest to the smaller diameter end of the frusto-conical male formation 24.

Referring to the axially rearward portion, it is shown that the angle which this portion of the depression 26.3 forms is slightly shallower or narrower than the angle which the protruding face 16.3 forms with an axis of the socket. Thus, toward the axially rearward side of the rocking formation 19.3, 29.3, a clearance space is provided which allows lost motion, and thus, rocking about the rocking formation 19.3 and 29.3. This clearance space extends from the rocking formation to the larger diameter end of the frusto-conical male formation 24.

Referring to the axially forward portion, it is shown that the angle which this portion of the depression 26.3 forms is slightly greater than the angle which the protruding face 16.3 forms with an axis of the socket. Thus, toward the axially forward side of the rocking formation 19.3, 29.3, a clearance space is provided which allows lost motion, and thus, rocking about the rocking formation 19.3 and 29.3. This clearance space extends from the rocking formation to the smaller diameter end of the frusto-conical male formation 24.

When the drill bit 10 is to be detached or removed from the drill rod 20, in accordance with the invention, an impact is delivered to the drill bit 10, e.g. by means of a hammer, at a position in register with any one of the two areas of maximum clearance, i.e., on the body of the drill bit 10 remote from the rocking formation 19.3. Such impact breaks static friction between the walls of the components to release the drill bit 10 and to allow it to be removed from the drill rod 20.

The applicant regards the invention as having the advantage that positive driving between the drill rod and the drill bit is provided, in combination with a feature allowing for easy separation of the drill bit from the drill rod.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A combination of a drill rod and a drill bit comprising:

the drill rod includes a generally frusto-conical end portion, and the frusto-conical end portion contains a depression therein;

the drill bit includes a generally frusto-conical socket complementary to the frusto-conical end portion of the drill rod, the socket includes a generally radially inwardly protruding face complementary to the depression in the frusto-conical end portion of the drill rod; and the drill bit being received over the drill rod such that the generally frusto-conical socket surrounds the generally frusto-conical end portion of the drill rod, and the protruding face seats in the depression.

2. A combination of a drill rod and a drill bit comprising:

the drill rod includes a generally frusto-conical end portion, and the frusto-conical end portion contains a depression therein;

the drill bit includes a generally frusto-conical socket complementary to the frusto-conical end portion of the drill rod, the socket includes a generally radially inwardly protruding face complementary to the depression in the frusto-conical end portion of the drill rod;

the drill bit being received over the drill rod such that the generally frusto-conical socket surrounds the generally frusto-conical end portion of the drill rod, and the protruding face seats in the depression; and wherein the drill bit socket is received over the frusto-conical end portion of the drill rod so that the depression and the protruding face abut thereby defining a rocking formation with a clearance space between the protruding face and the depression, and the clearance space extends away from the rocking formation so as to provide pivotal lost motion about the rocking formation.

3. The combination of claim 2 wherein the clearance space becomes greater as the frusto-conical end portion and the socket move away from the rocking formation.

4. The combination of claim 2 in which the rocking formation is provided nearest to the smaller ends of the frusto-conical end portion and the socket, and the clearance space extending toward the larger ends of the frusto-conical end portion and the socket.

5. The combination of claim 4 wherein the clearance space is at a maximum at the larger ends of the frusto-conical end portion and the socket.

6. The combination of claim 4 in which the surface of the depression extends from the rocking formation toward the larger end of the frusto-conical end portion at a predetermined depression included angle relative to the longitudinal axis of the drill rod, and the protruding face extends from the rocking formation toward the larger end of the socket at a predetermined protruding face included angle relative to the longitudinal axis of the socket, and the protruding face included angle being larger than the depression included angle so as to form the clearance space between the surface of the depression and the protruding face.

7. The combination of claim 2 in which the rocking formation is provided nearest to the larger ends of the frusto-conical end portion and the socket, and the clearance space extending toward a smaller ends of the frusto-conical end portion and the socket.

8. The combination of claim 7 wherein the clearance space is at a maximum at the smaller ends of the frusto-conical end portion and the socket.

9. The combination of claim 7 wherein the surface of the depression extends from the rocking formation toward the smaller end of the drill rod at a predetermined depression included angle relative to the longitudinal axis of the drill rod, and the protruding face extends from the rocking formation toward the smaller end of the socket at a predetermined protruding face included angle relative to the longitudinal axis of the socket, and the depression included angle being larger than the protruding face included angle so as to form the clearance space between the surface of the depression and the protruding face.

10. The combination of claim 2 in which the rocking formations is provided intermediate the smaller ends and the larger ends of the frusto-conical end portion and the socket, and a clearance space being provided to extend away from the rocking formation toward each of the smaller ends and the larger ends of the frusto-conical end portion and the socket.

11. The combination of claim 10 wherein the depression and the protruding face extend from the rocking formation divergingly longitudinally to both the larger ends and to the smaller ends of the frusto-conical end portion and the socket.

12. A method of releasing a drill bit received over an end of a drill rod in which the drill rod has a generally frusto-conical male end formation and the drill bit has a complementary generally frusto-conical socket formation; the drill rod and the drill bit have on their respective frusto-conical formations an inter-abutting rocking formation at an asymmetric angular position and form a clearance space longitudinally adjacent the rocking formation providing pivotal lost motion about the rocking formation between the drill rod and the socket, the method comprises the step of:

delivering an impact to the drill bit at a predetermined position adjacent to the point where the clearance is greatest so as to cause rocking about the rocking formation so as to break static frictional engagement between the male formation and the socket formation.

* * * * *